US007571507B2

(12) United States Patent
Holicki

(10) Patent No.: US 7,571,507 B2
(45) Date of Patent: Aug. 11, 2009

(54) WHEELCHAIR PLATFORM AND DETACHABLE RAMP, AND METHODS OF CONSTRUCTING AND UTILIZING SAME

(76) Inventor: Joseph P. Holicki, 111 Carlyle Ave., Coldwater, MI (US) 49036

( * ) Notice: Subject to any disclaimer, the term of this patent is extended or adjusted under 35 U.S.C. 154(b) by 0 days.

(21) Appl. No.: 11/963,070

(22) Filed: Dec. 21, 2007

(65) Prior Publication Data

US 2009/0158536 A1 Jun. 25, 2009

(51) Int. Cl.
*E01D 1/00* (2006.01)

(52) U.S. Cl. ..... 14/69.5

(58) Field of Classification Search ..... 14/69.5
See application file for complete search history.

(56) References Cited

U.S. PATENT DOCUMENTS

| | | | | | |
|---|---|---|---|---|---|
| 3,030,645 | A * | 4/1962 | Shaw | 14/69.5 |
| 4,697,294 | A * | 10/1987 | Schafer | 14/69.5 |
| 4,823,421 | A * | 4/1989 | Kleynjans et al. | 14/71.3 |
| 5,105,915 | A * | 4/1992 | Gary | 187/200 |
| 5,406,777 | A * | 4/1995 | Porto | 53/513 |
| 5,870,788 | A * | 2/1999 | Witkin | 14/69.5 |
| 6,418,675 | B1 * | 7/2002 | Peggs et al. | 52/102 |
| 6,481,036 | B1 * | 11/2002 | Duvall | 14/69.5 |
| 6,718,588 | B1 * | 4/2004 | Frederiksen | 14/69.5 |
| 6,840,558 | B1 * | 1/2005 | Darbishire et al. | 296/26.09 |
| 6,880,194 | B2 * | 4/2005 | O'Donnell et al. | 14/69.5 |
| 6,929,553 | B1 * | 8/2005 | Diemert | 472/118 |
| 7,003,836 | B2 * | 2/2006 | Berg | 14/69.5 |
| 7,010,825 | B1 * | 3/2006 | Finch Salas et al. | 14/72.5 |
| 7,240,388 | B2 * | 7/2007 | Warford | 14/69.5 |
| 7,350,255 | B2 * | 4/2008 | Zhang | 14/69.5 |
| 2002/0144364 | A1 * | 10/2002 | Anderson et al. | 14/69.5 |
| 2005/0123380 | A1 * | 6/2005 | Massaro | 414/10 |
| 2005/0129490 | A1 * | 6/2005 | Hutchins | 414/462 |
| 2008/0028546 | A1 * | 2/2008 | Fullerton et al. | 14/71.1 |

* cited by examiner

*Primary Examiner*—Raymond W Addie
(74) *Attorney, Agent, or Firm*—Weiner & Burt, P.C.; Irving M. Weiner; Pamela S. Burt

(57) ABSTRACT

A combination wheelchair platform and detachable ramp to allow a person seated in the wheelchair to be at the proper height for an opthalmologic slit lamp examination, or for a standard size dining table. The platform and ramp have raised side members to prevent accidental rolling off.

6 Claims, 4 Drawing Sheets

FIG. 7
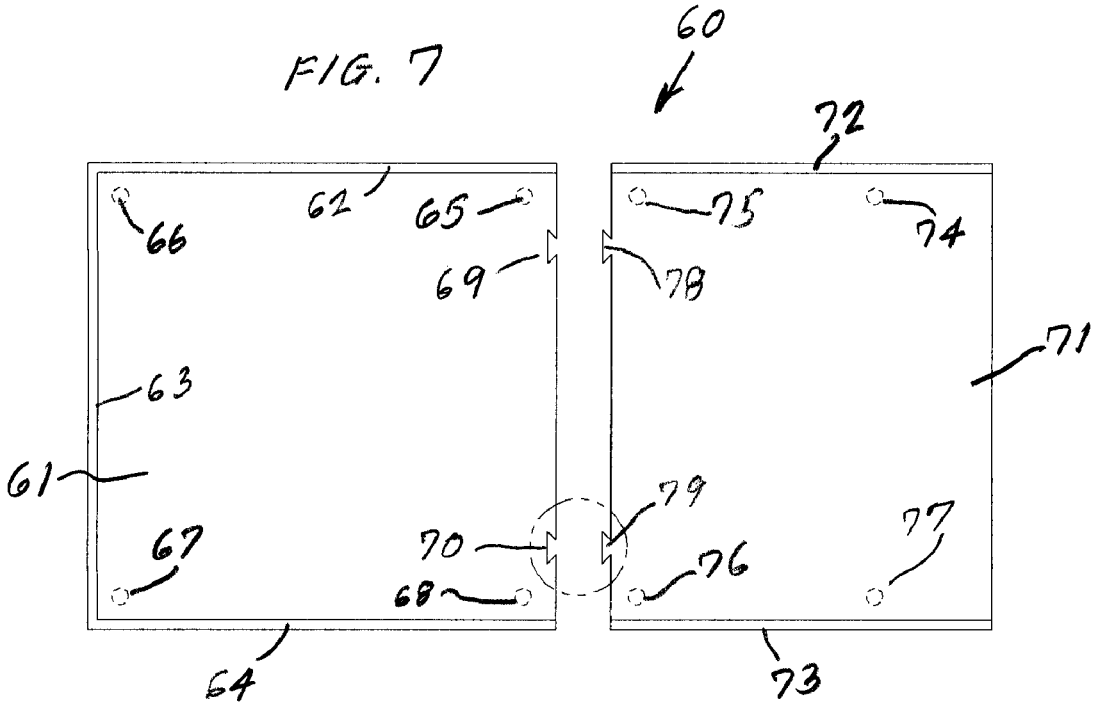
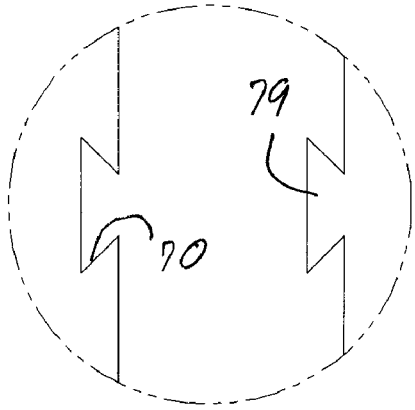
FIG. 8

FIG. 9
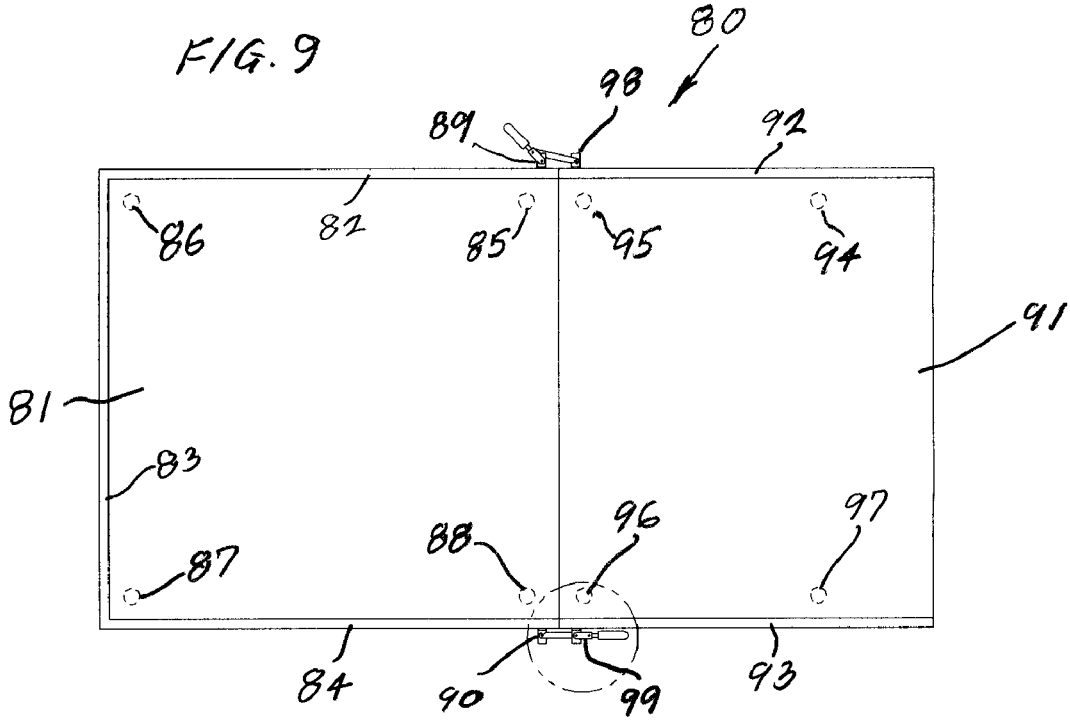
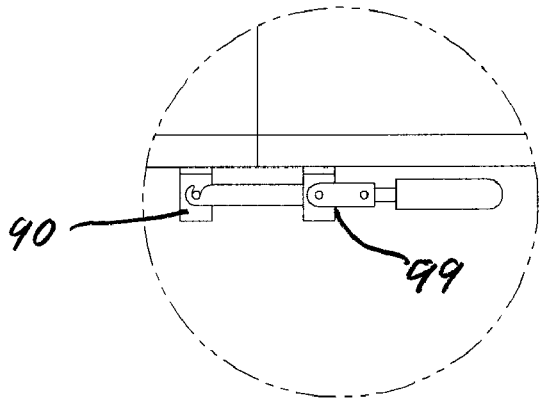
FIG. 10

WHEELCHAIR PLATFORM AND DETACHABLE RAMP, AND METHODS OF CONSTRUCTING AND UTILIZING SAME

CROSS-REFERENCE TO RELATED APPLICATIONS

Not Applicable.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The present invention relates to novel and unique wheelchair platforms and detachable ramps, and methods of constructing and utilizing same.

More particularly, the present invention relates to a wheelchair platform and detachable ramp to allow a person seated in a wheelchair to be at an elevated position for treatment or examination (such as, an opthalmologic slit lamp examination, or for convenience at a table, or use with an exercise apparatus The prior, but not necessarily relevant, art is exemplified by:

Petersen U.S. Pat. No. 3,818,528;

Pestes United States Patent Application Publication 2003/0203792; and

Diemert U.S. Pat. No. 6,929,553.

It is a desideratum of the present invention to avoid the animadversions of conventional and present devices, and at the same time to provide a very convenient and easy to use and store wheelchair platform and detachable ramp apparatus and system.

SUMMARY OF THE INVENTION

The present invention provides a combination wheelchair platform and detachable ramp, comprising: a wheelchair platform having three raised upper side members and an open side; said platform has a wheelchair-receiving surface surrounded by side members and said open side; a detachable ramp for selective and releasable connection to said platform to enable a wheelchair to move on said ramp to and from said wheelchair-receiving surface of said platform; and attachment means operably connected with said platform and ramp to facilitate selective and releasable attachment and detachment of said platform and ramp.

It is a primary object of the present invention to provide a wheelchair platform and detachable ramp to enable a person seated in a wheelchair to be in an elevated position (approximately six inches above the floor level) for the convenience of an opthalmologic slit lamp examination.

Another object of the present invention to provide a wheelchair platform and detachable ramp to enable a person seated in a wheelchair to be in an elevated position (approximately six inches above the floor level) for home use, for example, to elevate to a standard size dining room table.

Other objects, advantages, and features of the present invention will become apparent to those persons skilled in this particular area of technology and to other persons after having been exposed to the present patent application when read in conjunction with the accompanying patent drawings.

BRIEF DESCRIPTION OF THE DRAWINGS

FIG. 7 is a top plan view, partly in section, of a platform and ramp of a second embodiment of the present invention.

FIG. 8 is an enlarged view, partly in section, of the mating components circled in FIG. 7.

FIG. 9 is a top plan view, partly in section, of a platform and ramp of a third embodiment of the present invention.

FIG. 10 is an enlarged view, partly in section, of the locking components circled in FIG. 9.

DETAILED DESCRIPTION OF THE INVENTION

Figure 1:
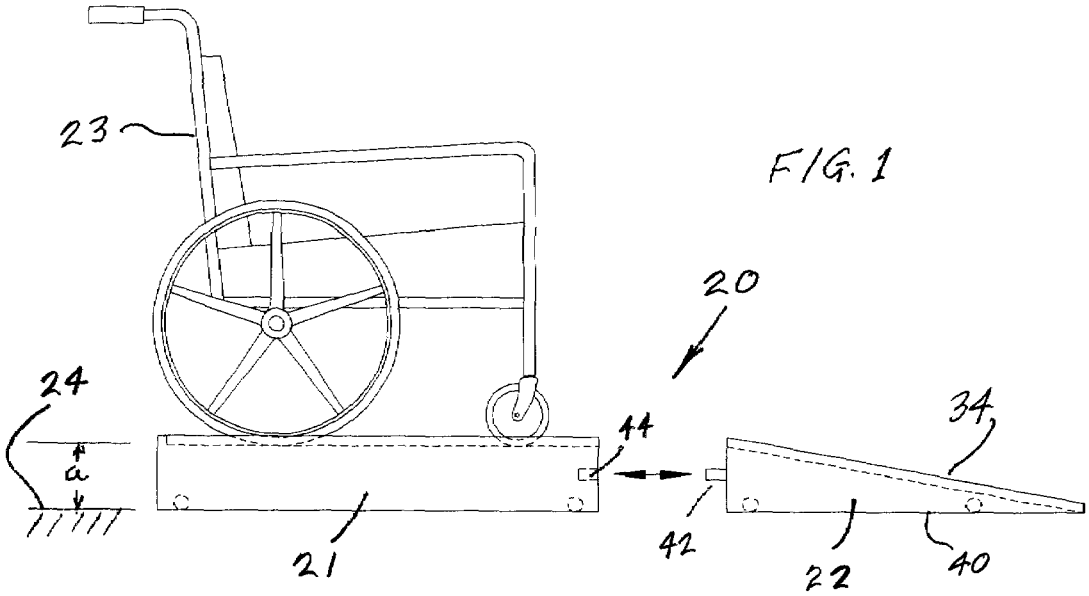
FIG. 1 is a side elevational view, partly in section, of a first embodiment of the present invention.
Figure 2:
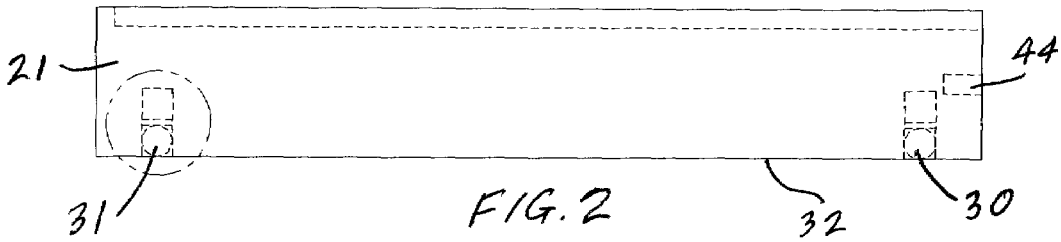
FIG. 2 is a side elevational view, partly in section, of the platform of the apparatus depicted in FIG. 1.
Figure 3:
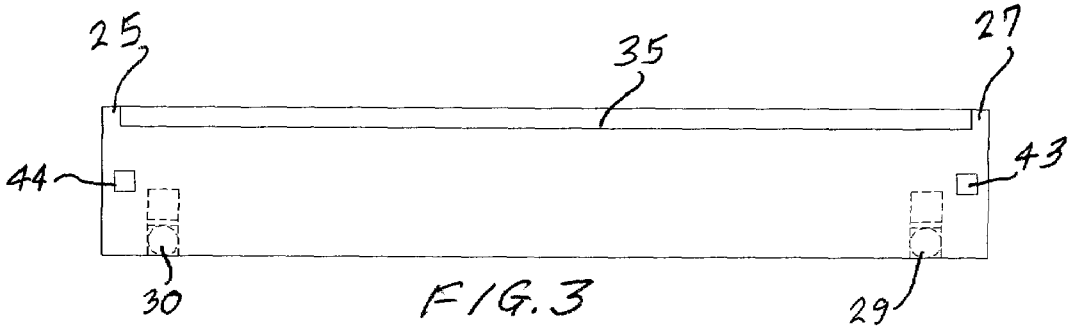
FIG. 3 is a front elevational view, partly in section, of the platform of the apparatus depicted in FIG. 1.

FIGS. 1-6 illustrate an apparatus 20 including a wheelchair platform 21 and a detachable ramp 22 in accordance with a first embodiment of the invention.

The platform 21 has any desired height, and other dimensions to accommodate the smallest to largest wheelchair 23. Preferably, but not necessarily, the platform 21 may have a height dimension "a" to elevate the wheelchair 23 approximately six inches above the floor 24 for the convenience of an opthalmologic examination, or at standard size dining table, etc.

The platform 21 is provided with three raised sides 25, 26 and 27 to prevent the wheelchair 23 from rolling off the chair-receiving surface 35 of the platform 21.

Once the wheelchair 23 is in position on the platform 21, the brakes of the wheelchair 23 prevent the wheelchair 23 from rolling forward.

Preferably, but not necessarily, the platform 21 may include wheels 28, 29, 30 and 31 at its bottom side 32 to provide ease in positioning or moving the platform 21.

Figure 5:
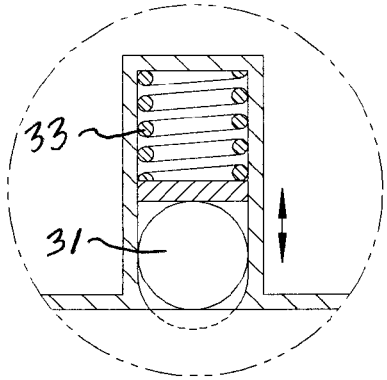
FIG. 5 is an enlarged sectional view of the spring-loaded wheel circled in FIG. 2.

As best seen in FIG. 5, each wheel arrangement may be a spring-loaded wheel that includes a spherical ball wheel, e.g., wheel 31, biased downwardly by a spring 33. In this manner, when weight is applied to the platform 21, the platform 21 will rest on the floor 24.

Figure 4:
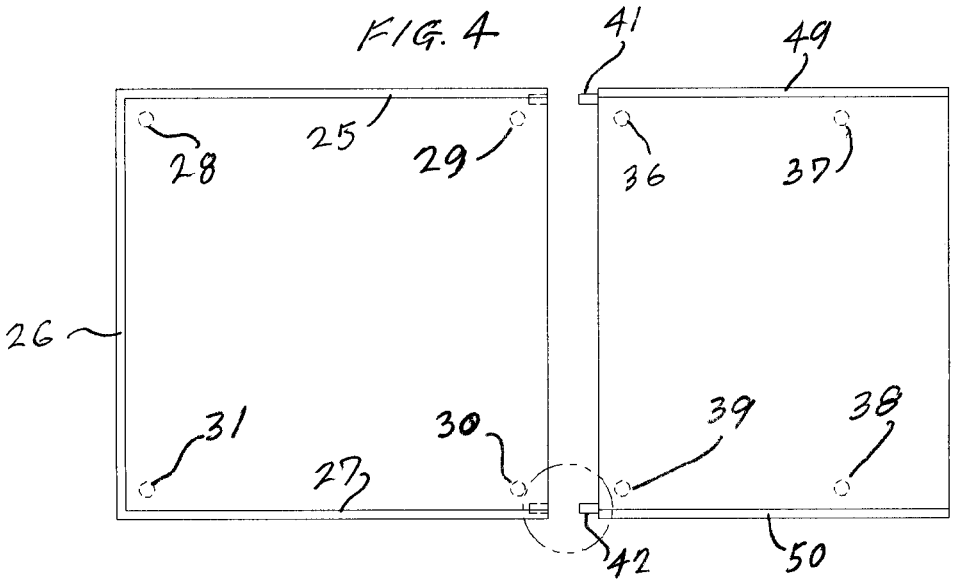
FIG. 4 is a top plan view, partly in section, of the platform and ramp depicted in FIG. 1.

The ramp 22 is the same width as the platform 21 as best illustrated in FIG. 4.

The ramp 22 is provided with a gentle slope or grade 34 to provide ease of movement of the wheelchair 23 from the floor 24 onto the chair-receiving surface 35 of the platform 23.

Preferably, but not necessarily, the ramp 22 may include wheels 36, 37, 38 and 39 (similar to the spring-loaded wheels 28, 29, 30 and 31) at its bottom side 40 to provide ease in positioning or moving the ramp 22.

Preferably, but not necessarily, the platform 21 and the ramp 22 may also be provided with rubber footings to prevent sliding on hard surfaced floors.

The platform 21 and ramp 22 are provided with mating components for facilitating selectable and releasable attachment and detachment of the platform 21 and ramp 22.

The ramp 22 may be provided with male components 41 and 42 for mating with female components 43 and 44, respectively, of the platform 21.

Alternatively, the platform 21 may be provided with male components 41 and 42 for mating with female components 43 and 44, respectively, of the ramp 22.

Figure 6:
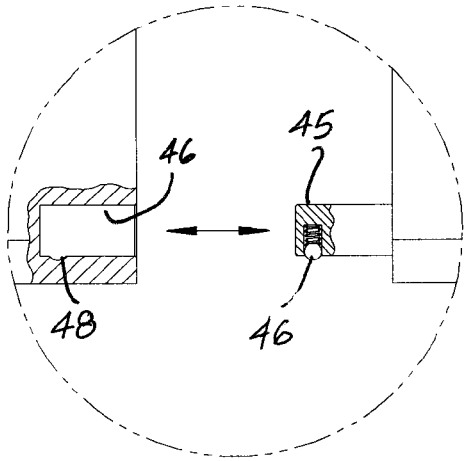
FIG. 6 is an enlarged view, partly in section, of the mating components circled in FIG. 4

The mating components are best illustrated in FIG. 6. For example, the male component 42 includes a projection member 45 having a spring-loaded ball 46. The female component 44 includes a chamber member 47 for receiving the projection member 45, and also includes a detent 48 in which the spring-loaded ball 46 may releasably be received.

The ramp 22 is provided with raised sides 49 and 50.

With reference to FIGS. 7 and 8, there is illustrated an apparatus 60 in accordance with a second embodiment of the present invention.

The apparatus 60 includes a platform 61 having three raised sides 62, 63 and 64, spring-loaded wheels 65, 66, 67 and 68, and dovetail mortises 69 and 70.

The apparatus 60 also includes a detachable ramp 71 having two raised sides 72 and 73, spring-loaded wheels 74, 75, 76 and 77, and dovetail tenons 78 and 79.

The male tenons 78 and 79 slide down into the female mortises 69 and 70, respectively.

Alternatively, the platform 61 can have the tenons 78 and 79; and the ramp 71 can have the mortises 69 and 70.

With reference to FIGS. 9 and 10, there is illustrated an apparatus 80 in accordance with a third embodiment of the present invention.

The apparatus 80 includes a platform 81 having three raised sides 82, 83 and 84, spring-loaded wheels 85, 86, 87 and 88, and quick-release toggle clamp members 89 and 90.

The apparatus 80 also includes a detachable ramp 91 having two raised sides 92 and 93, spring-loaded wheels 94, 95, 96 and 97, and quick-release toggle clamp members 98 and 99.

The clamp members 98 and 99 mate with clamp members 89 and 90, respectively, to provide quick-release toggle clamps for selectively locking together the platform 81 and the detachable ramp 91.

Preferably, but not necessarily, the platform and/or ramp of any embodiment of the present invention can be provided with friction material on a top surface thereof, and/or rubber footings on a bottom surface thereof to prevent sliding on hard surfaced floors.

There have been illustrated in the accompanying drawings and described hereinabove several of the unique and novel embodiments of the present invention which can be practiced and constructed in many different configurations, arrangements of components, sizes, and shapes.

It should be understood that many changes, modifications, variations, and other uses and applications will become apparent to those persons skilled in this particular area of technology and to others after having been exposed to the present patent specification and accompanying drawings.

Any and all such changes, modifications, variations and other uses and applications which do not depart from the spirit and scope of the present invention are therefore covered by and embraced within the present invention and the patent claims set forth hereinbelow.

The invention claimed is:

1. A combination wheelchair platform and detachable ramp, comprising:

a wheelchair platform having three raised upper side members and an open side;

said platform has a wheelchair-receiving surface surrounded by said side members and said open side;

a detachable ramp for selective and releasable connection to said platform to enable a wheelchair to move on said ramp to and from said wheelchair-receiving surface of said platform;

attachment means operably connected with said platform and ramp to facilitate selective and releasable attachment and detachment of said platform and ramp; and said attachment means comprises male members with spring-loaded ball members which mate with female members having detents for receiving said spring-loaded ball members.

2. A combination wheelchair platform and detachable ramp according to claim 1, wherein:

said platform is provided with first means for moving said platform relative to an external floor; and said first means causing a bottom surface of said platform to rest in place against the floor when weight is applied to said platform.

3. A combination wheelchair platform and detachable ramp according to claim 2, wherein:

said detachable ramp is provided with moving means for moving said platform relative to the floor; and said moving means causing a bottom surface of said detachable ramp to rest in place against the floor when weight is applied to said detachable ramp.

4. A combination wheelchair platform and detachable ramp according to claim 1, wherein:

said detachable ramp is provided with moving means for moving said platform relative to an external floor; and said moving means causing a bottom surface of said detachable ramp to rest in place against the floor when weight is applied to said detachable ramp.

5. A combination wheelchair platform and detachable ramp according to claim 4, wherein:

said wheelchair-receiving surface of said platform is at predetermined distance above the floor to enable an user of the wheelchair to be at an elevation convenient for an opthalmologic slit lamp examination of the user of the wheelchair while the user is seated in the wheelchair positioned on said wheelchair-receiving surface of said platform.

6. A combination opthalmologic slit lamp examination wheelchair platform and detachable ramp, comprising:

a wheelchair platform having three raised upper side members and an open side;

said platform has a wheelchair-receiving surface surrounded by side members and said open side;

a detachable ramp for selective and releasable connection to said platform to enable a wheelchair to move on said ramp to and from said wheelchair-receiving surface of said platform;

attachment means operably connected with said platform and ramp to facilitate selective and releasable attachment and detachment of said platform and ramp;

said attachment means comprises one or more quick-release toggle clamps;

said platform is provided with first means for moving said platform relative to an external floor;

said first means causing a bottom surface of said platform to rest in place against the floor when weight is applied to said platform;

said first means comprises spring-loaded wheels;

said detachable ramp is provided with moving means for moving said platform relative to the floor;

said moving means causing a bottom surface of said detachable ramp to rest in place against the floor when weight is applied to said detachable ramp; and said wheelchair-receiving surface of said platform is at predetermined distance above the floor to enable an user of the wheelchair to be at an elevation convenient for an opthalmologic slit lamp examination of the user of the wheelchair while the user is seated in the wheelchair positioned on said wheelchair-receiving surface of said platform.

* * * * *